US006763818B2

(12) United States Patent
Larson

(10) Patent No.: US 6,763,818 B2
(45) Date of Patent: Jul. 20, 2004

(54) COMPOUND ARCHERY BOW

(75) Inventor: Marlow W. Larson, Ogden, UT (US)

(73) Assignee: Larson Archery Co., Ogden, UT (US)

( * ) Notice: Subject to any disclaimer, the term of this patent is extended or adjusted under 35 U.S.C. 154(b) by 0 days.

(21) Appl. No.: 10/096,604

(22) Filed: Mar. 12, 2002

(65) Prior Publication Data

US 2002/0129803 A1 Sep. 19, 2002

Related U.S. Application Data

(60) Provisional application No. 60/275,305, filed on Mar. 14, 2001.

(51) Int. Cl.[7] ..... F41B 5/10
(52) U.S. Cl. ..... 124/25.6
(58) Field of Search ..... 124/25.6, 86, 900

(56) References Cited

U.S. PATENT DOCUMENTS 4,669,445 A * 6/1987 Schaar
5,623,915 A * 4/1997 Kudlacek ..... 124/25.6
5,687,703 A * 11/1997 Vyprachticky ..... 124/25.6
6,474,324 B1 * 11/2002 Despart et al. ..... 124/25.6

* cited by examiner

*Primary Examiner*—John A. Ricci
(74) *Attorney, Agent, or Firm*—Brian C. Trask

(57) ABSTRACT

A rigging structure for a compound archery bow includes first and second pulley assemblies, pivotally mounted on axles at tips of corresponding first and second limbs of a compound bow. Each pulley assembly includes: a central string pulley component with a peripheral string groove; and first and second cable pulley components, each having peripheral cable groves. The first and second cable pulley components are fixed in straddling relation with respect to the string pulley component. A bowstring's opposite ends are connected directly to the first and second pulley assemblies such that, at rest condition of the bow, the peripheral string grooves are substantially occupied by wrapped bowstring. A first cable segment is carried by the first pulley assembly, such that opposite end stretches of the first cable segment extend from the respective cable grooves of the first pulley assembly to anchor to the second bow limb. A second cable segment is carried by the second pulley assembly, such that opposite end stretches of the second cable segment extend from the respective cable grooves of the second pulley assembly to anchor to the first limb.

10 Claims, 3 Drawing Sheets

COMPOUND ARCHERY BOW

RELATED APPLICATIONS

This application claims the benefit under 35 U.S.C. 119(e) of the filing date of Provisional Application Serial No. 60/275,305, filed Mar. 14, 2001 for "COMPOUND ARCHERY BOW".

BACKGROUND OF THE INVENTION

1. Field of the Invention

This invention relates to compound archery bows. It is particularly directed to an improved rigging system for such bows.

2. State of the Art

Compound archery bows commonly carry assemblies of pulley members (usually called "eccentrics" or "cams") eccentrically mounted on axles in association with respective bow limbs. These limbs extend in opposite directions from a grip (usually comprising a central portion of a handle riser). The rigging for compound bows includes a bow string trained around the pulley members of the system, the string being received by grooves or other features at the perimeters of the pulleys. The eccentric pulley assemblies are conventionally mounted to rotate (pivot) on an axle within a notch at the distal end of the limb, or within a bracket structure carried by the limb tip. The eccentrics include one or more pivot holes substantially offset from center, whereby to provide for a reduction in the holding force felt at the nocking point of the bow string, as the string is moved to its fully drawn condition.

Compound bows and various exemplary pulley assemblies are described by U.S. Pat. Nos. 4,748,962; 4,774,927; and 4,967,721, the disclosures of which are incorporated as a portion of this disclosure.

The rigging for compound bows typically includes cable segments, which may be end stretches extending from an integral bowstring. More often, however, the cable segments are separate elements, each connecting at one end, directly or indirectly, e.g., through structure associated with the pulley assembly, to a terminal end of the bowstring. The remaining (distal) ends of the cable segments are conventionally connected to the opposite bow limb or structure, such as the pivot axle mount of the pulley assembly carried by that limb. In any case, each cable segment includes one or two stretches oriented approximately parallel the bow string. "Approximately parallel," is intentionally fluid in context, merely recognizing that the cable segments and bowstring all extend generally across, but out of contact with, the handle riser portion of the bow between the pulley assemblies, or other structure, carried by the respective bow limbs. All of the cable stretches are thus confined within a space defined by reference planes straddling the handle riser and containing the bow string. The cable stretches are commonly positioned to one side of the bowstring to avoid interference with the nocking point of the bowstring. It is common practice to mount cable guard rods or other structures to the handle riser. These structures are positioned to physically hold the cables away from the plane of travel of the bowstring.

With a compound bow oriented in its normal position of use, it is conventional to consider the bow as being oriented vertically. Unless otherwise stated, the bows referred to in this disclosure are assumed to be in this "vertical" orientation. The handle riser is thus considered to have an "upper end" and a "lower end." The limb extending from the upper end of the handle riser may be referred to as "a first limb" or the "upper limb," in either case terminating in an "upper limb tip." Corresponding terminology is applied to the "second limb," which extends from the lower end of the handle riser. The bow string is assumed to travel in a plane of travel between a fully drawn condition and braced or at rest condition. Cable stretches may be viewed as being positioned to the left or right of the plane of travel of the bowstring, recognizing that in some rigging systems, a cable stretch may be to one side of that plane of travel along the first limb and to the opposite side of that plane of travel as the stretch proceeds to its point of attachment at the second limb. The variety of rigging configurations present in the field is explained in part by different approaches taken by bow designers with respect to the balancing of forces applied to limb tips, axles, limb mountings and other bow components by the cable stretches under actual use conditions. Some compound bows have required the use of multiple cable guards to assure sufficient arrow clearance, because of the close proximity of the cable stretches to the travel plane of the bowstring. upper and lower cable guards have been used, for example, in bow constructions in which cable stretches are positioned both to the left and to the right of the bowstring.

SUMMARY OF THE INVENTION

This invention provides a rigging system comprising first and second pulley assemblies, mounted to pivot on axles mounted at tips of corresponding first and second limbs of a compound bow constructed in generally conventional fashion. Each assembly includes a central string pulley component with a peripheral string groove. The string pulley components are either identical or mirror images of each other in configuration. They may be of various cross sectional configuration, but are most conveniently circular. They may be mounted concentrically; that is, to pivot around their geometric centers, but are preferably mounted eccentrically; that is, to pivot around respective axes displaced from their geometric centers. Opposite ends of a bowstring are connected directly to the respective pulley assemblies such that, at rest condition of the bow, the peripheral string grooves are substantially occupied by wrapped bowstring.

Straddling the string pulley component of each assembly are first and second cable pulley components, each having peripheral cable groves. These components are congruent with respect to each other, and may also be of various cross sectional shape, including circular, but they are usually non-circular. A first cable segment is carried by the first pulley assembly, such that opposite end portions (cable end stretches) of that cable segment extend from the respective cable grooves of the assembly, across the grip portion of the bow, to anchor to the second limb, preferably with respective terminations fastened to opposite sides of the axle mounting the second pulley assembly. A second cable segment is carried in identical fashion by the second pulley assembly, with its terminations anchored to the first limb.

In most instances, the midpoints of the cable segments will be located internal the pulley assembly proximate the transverse center of the string pulley. The cable segments may be "floating" with respect to the pulley assemblies; that is, the midpoints of the respective cable segments may be free to shift slightly in position in response to unequal forces seen by the respective end stretches of a cable segment. Alternatively, the first and second cable segments may be physically anchored to the respective first and second pulley assemblies to hold the cable midpoints in substantially fixed lateral position with respect to the axles associated with the respective pulley assemblies.

The pulley assemblies may be structured with sufficient width to permit passage of a launched arrow between the cables, without the use of a cable guard. In certain embodiments, however, cable spreading structure is positioned between the cable segments located on opposite sides of the bow string. Such cable spreading structure may be mounted to extend from the handle riser to between cable stretches located to the right and left of the bowstring. The cable spreading structure is structured and arranged to hold those left and right cable stretches away from the vicinity of the bow string while permitting free travel of the nocking point of the bowstring from fully drawn to braced position. In a currently preferred arrangement, a plate is mounted to extend in cantilever fashion from the handle riser between the left and right cable stretches. An open slot or channel in the plate accommodates movement of the bowstring, while the edges of the plate maintain adequate spacing of the cable stretches as the bowstring is drawn or released. Interface fixtures may be positioned between the plate edges and the cable stretches to reduce friction and wear on the cable. The interface fixtures may be configured in a variety of specific forms, provided they are constructed and arranged to travel along the edges of the plate while providing a mobile anchorage for the cable segments. Alternative arrangements substitute approximately parallel rods extending, preferably from a mounting fixture, from the handle riser.

A compound archery bow construction which benefits from the cable spreading structure of this invention typically comprises a handle riser, with upper and lower respective ends; a first bow limb, extending from the upper end of the handle riser to terminate in a distal upper limb tip; a second bow limb, extending from the lower end of the handle riser to terminate in a distal lower limb tip; rigging such as that previously described, or at least comprising first and second pulley assemblies mounted to pivot on axles carried by the upper and lower limb tips, respectively, the rigging including a central bow string and a plurality of cable stretches extending approximately parallel the bow string between the upper and lower limb tips such that the bow string is located between left and right cable stretches. That is, one cable stretch extending from each pulley assembly is located to the right of the bowstring, and one other cable stretch extending from each pulley assembly is located to the left of the bowstring (more precisely, the reference plane intersecting the bowstring axes during all positions of its normal travel).

The cable spreading structure typically extends from the handle to between the left and the right cable stretches; it is generally structured and arranged to hold the left and right cable stretches away from the vicinity of the bow string, while permitting free travel of a nocking point of the bowstring from fully drawn to braced position. The cable spreading structure may take a variety of specific forms, but one particularly effective version includes a plate element with a distal slot configured to accommodate movement of the bowstring. The plate is a component of an assembly which includes a traveling fixture with a first element constructed and arranged to retain an adjacent cable stretch, and a second element constructed and arranged to couple in sliding engagement with an edge of the plate. As applied to a compound archery bow with rigging structured and arranged as illustrated by the accompanying drawings, with an end stretch of each of the cable segments positioned to the right of the bowstring and an end stretch of each the cable segments positioned to the left of the bowstring, the plate may be relatively thin to present approximately parallel right and left edges. The assembly may then include a first traveling fixture with a first element constructed and arranged to retain those of the cable end stretches located to the right of the bowstring and a second element constructed and arranged to couple in sliding engagement with the right edge of the plate. Such an assembly may further include a second traveling fixture with a first element constructed and arranged to retain those of the cable end stretches located to the left of the bowstring and a second element constructed and arranged to couple in sliding engagement with the left edge of the plate.

BRIEF DESCRIPTION OF THE DRAWINGS

In the drawings, which illustrate what is currently considered to be the best mode for carrying out the invention.

DETAILED DESCRIPTION OF THE ILLUSTRATED EMBODIMENT

Figure 5:
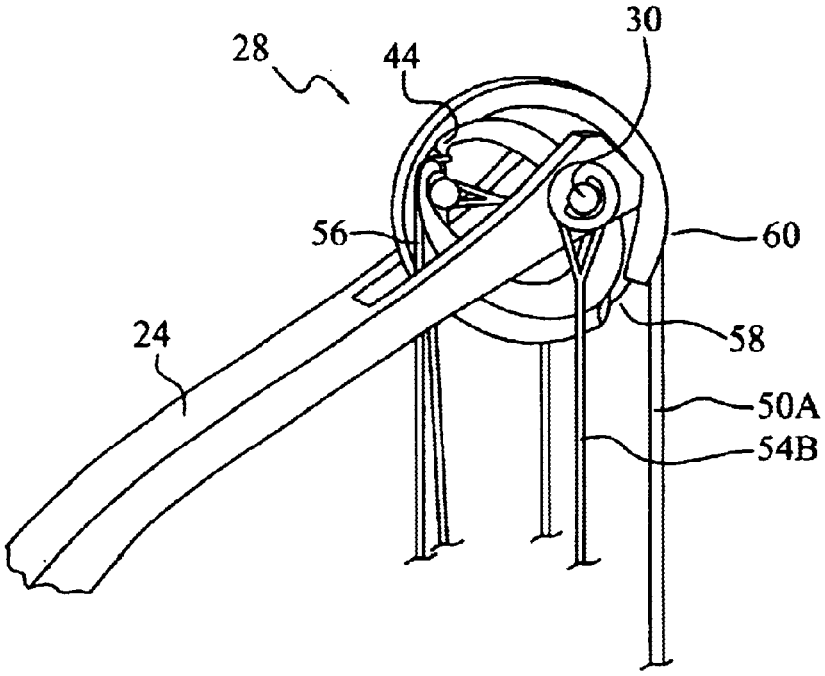
FIG. 5 is a view similar to FIG. 4, viewing the opposite side of the assembly of FIG. 4.

As illustrated, a bow of this invention, generally 20, may be constructed in conventional fashion with a handle riser section, generally 22, supporting oppositely extending upper limb 24 and lower limb 26 elements. An upper pulley assembly, generally 28, is mounted to rotate, either with or on an upper axle 30 (FIG. 5). A lower pulley assembly, generally 32, is similarly mounted with respect to a lower axle 34.

The pulley assemblies 28, 32 may be approximately identical in structure, and are ideally, although not necessarily, symmetrical with respect to a central reference plane transverse their respective axes of rotation. In any case, as mounted, the upper assembly 28 is structured as a mirror image of the lower assembly 32. To avoid duplication of description, this disclosure will focus upon the details of construction of the upper assembly 28, it being understood that the lower assembly 32 has an identical appearance, as viewed from the handle riser 22, looking towards a limb tip.

Figure 1:
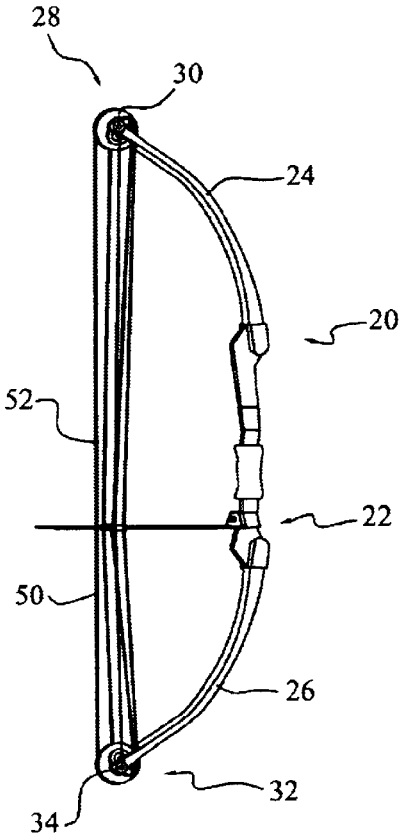
FIG. 1 is a pictorial view of an archery bow of this invention in "braced" or relaxed condition.
Figure 2:
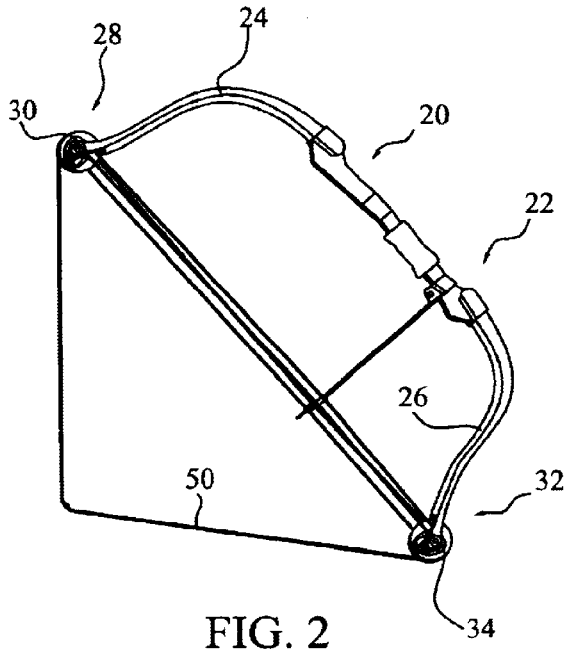
FIG. 2 is a view similar to FIG. 1, showing the bow of FIG. 1 held in fully drawn condition.
Figure 4:
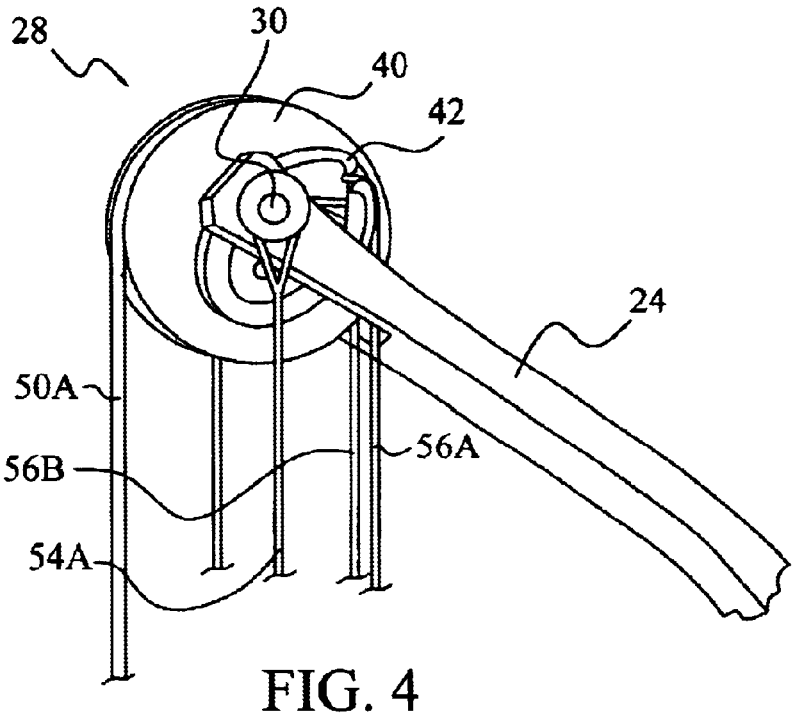
FIG. 4 is a pictorial view of the bow of FIG. 1, enlarged to show details of a pulley assembly of the invention.

Referring to FIGS. 4 and 5, a central string component 40 is straddled by approximately identical cable components 42, 44. As used in this disclosure, the term "string" refers to the central stretch 50 of a compound bow rigging, the segment which includes the arrow nocking point 52, regardless of its actual materials of construction. Similarly, the term "cable" refers to the end stretches 54, 56 of a compound bow rigging, the segments having no counterparts in a typical longbow string; that is, the portion of the rigging extending between the central stretch 50 and the bow limbs 24, 26, regardless of their materials of construction. As illustrated, the central stretch 50 is indirectly attached to the respective end stretch cables 54, 56 at respective pulley assemblies 28, 32. Thus, a first cable element 56 extends through the assembly 28, with opposite stretches 56A, 56B extending across the handle riser 22 for attachment to the axle 34 carried by the opposing limb 26 (FIG. 1) A second cable element 54 is similarly passed though the lower pulley assembly 32, such that opposite stretches 54A and 54B extend across the handle riser 22 and attach to the axle 30 at opposite sides of the limb 24, as best shown by FIGS. 4 and 5, respectively. The upper end 50A of the central stretch 50 is trained around a peripheral grove in the central string component 40 for nearly a full wrap, being anchored at its terminus to the pulley assembly 28. As illustrated, the end 50A is threaded through an opening through the peripheral string groove at a location 58 proximate (in rest condition, FIG. 1) the tangent point of contact 60 made by the string end 50A and the pulley string component 40. When the nocking point 52 is pulled towards full draw condition (FIG. 2), the pulley assembly turns, wrapping the proximal ends of cable stretches 56A, 56B into peripheral grooves of the pulley assembly cable components 42, 44.

Correspondingly, the string tangent point 60 migrates away from the entry location 58 as the string end 50A unwraps from the string component 40.

Figure 3:
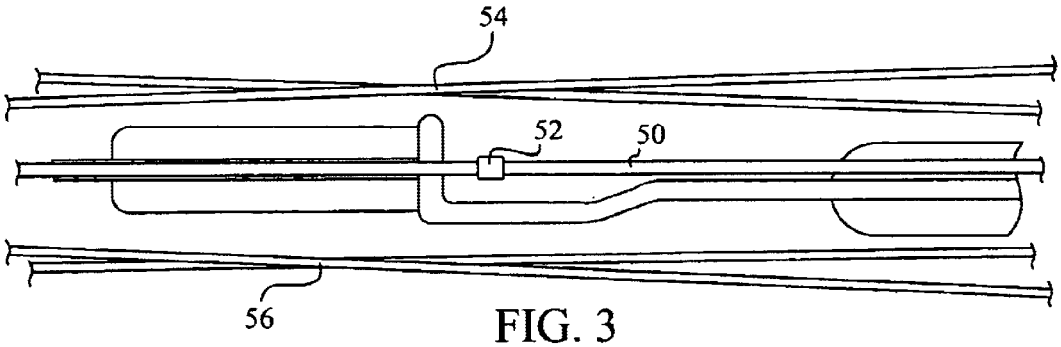
FIG. 3 is a partial plan view of the bow of FIG. 1 looking through its rigging towards its handle riser.
Figure 6:
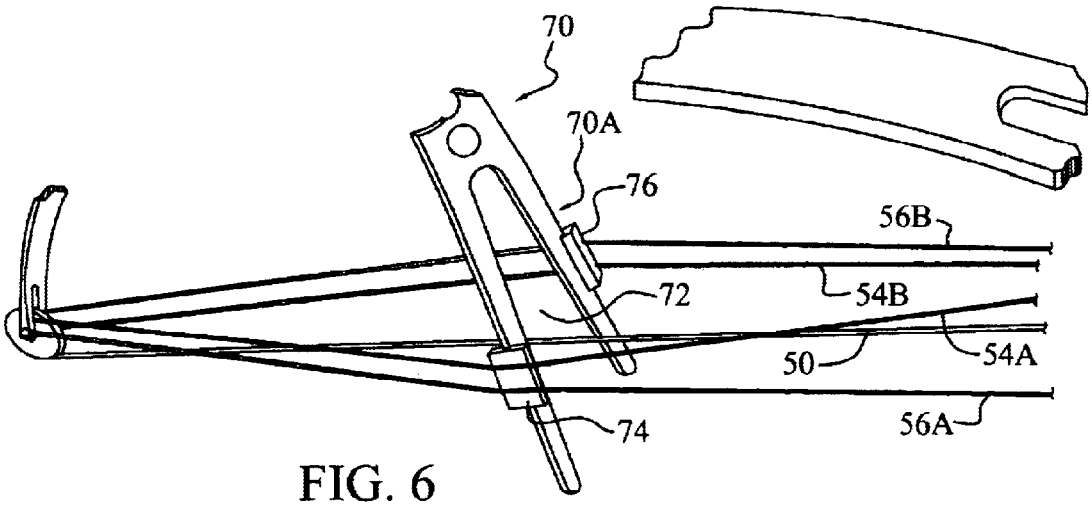
FIG. 6 is a partial pictorial view of the bow of FIG. 1, illustrating cable guard structure.
Figure 7:
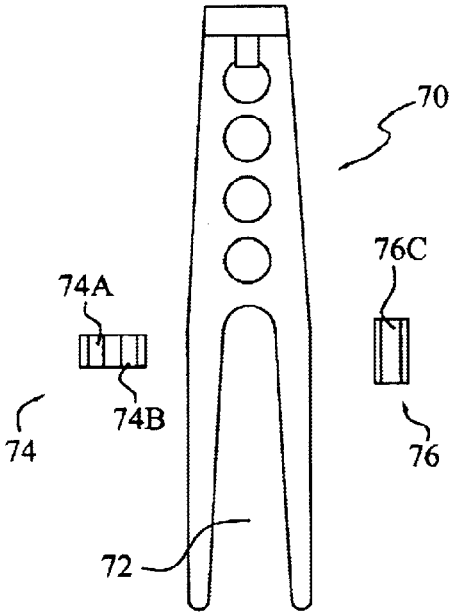
FIG. 7 is a plan view of components of the cable guard structure of FIG. 6.
Figure 8:
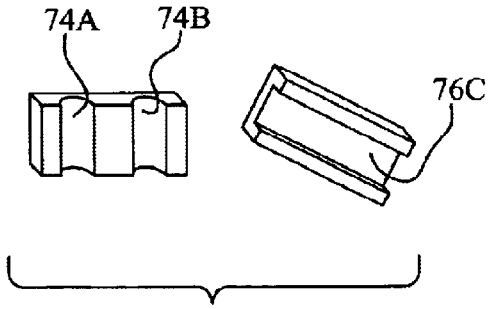
FIG. 8 is an enlarged pictorial view of certain components illustrated by FIG. 7.

As shown by FIG. 3, the pulley assemblies 28, 32 may be structured to provide sufficient spacing for the cables 54, 56, to permit an arrow to be launched between them. Nevertheless, additional spacing and stability may be provided by auxiliary structures, such as the cable guard plate 70 shown by FIG. 6. The string 50 resides within the slot 72 when the bow is in its at rest position. Referring to FIGS. 7 and 8, the cable stretches 54A and 56A are positioned in slots 74A, 74B in a glider block 74, and the cable stretches 54B and 56B are similarly positioned with respect to a second glider block 76. A slot 76C receives an edge 70A of the plate 70. The glider blocks 74, 76 are identical in structure and operation, serving to stabilize the cables as they move along the plate 70 as the string 50 is either pulled or released.

The cable structure of this invention, such as guard plate assembly illustrated, is generally useful in combination with any rigging arrangement which positions cable stretches on both the left and right sides of a bow string. The plate provides excellent stability, and avoids the need for multiple cable guard rods for such rigging arrangements.

While the invention has been described in particular with reference to a certain illustrated embodiment, such is not intended to limit the scope of the invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A compound archery bow, comprising:

a handle riser, with upper and lower respective ends;

a first bow limb, extending from said upper end of said handle riser to terminate in a distal upper limb tip;

a second bow limb, extending from said lower end of said handle riser to terminate in a distal lower limb tip;

rigging comprising first and second pulley assemblies mounted to pivot on axles carried by said upper and lower limb tips, respectively, said rigging including a central bow string and a plurality of cable stretches extending approximately parallel said bow string between said upper and lower limb tips such that said bow string is located between left and right said cable stretches; and cable spreading structure extending from said handle to between said left and said right cable stretches, said cable spreading structure being structured and arranged to hold said left and right said cable stretches away from the vicinity of said bow string while permitting free travel of a nocking point of said bowstring from fully drawn to braced position.

2. A compound archery bow according to claim 1, wherein said rigging comprises:

first and second pulley assemblies, mounted to pivot on respective axles at tips of corresponding first and second limbs of a compound bow; each assembly including:

a central string pulley component with a peripheral string groove; and first and second cable pulley components, each having peripheral cable groves, said first and second pulley components being approximately congruent in configuration and orientation, and being fixed in straddling relation with respect to said string pulley component;

a bowstring with opposite ends connected directly to said first and second pulley assemblies such that, at rest condition of the bow, the peripheral string grooves are substantially occupied by wrapped bowstring;

a first cable segment, carried by said first pulley assembly, such that opposite end stretches of said first cable segment extend from the respective cable grooves of said first pulley assembly to anchor to said second limb; and a second cable segment, carried by said second pulley assembly, such that opposite end stretches of said second cable segment extend from the respective cable grooves of said second pulley assembly to anchor to said first limb.

3. A compound archery bow according to claim 1, wherein said cable spreading structure includes a plate element with a distal slot configured to accommodate movement of said bowstring.

4. A compound archery bow according to claim 3, wherein said plate is a component of an assembly which includes a traveling fixture with a first element constructed and arranged to retain an adjacent cable stretch, and a second element constructed and arranged to couple in sliding engagement with an edge of said plate.

5. A compound archery bow according to claim 4, wherein: said rigging comprises:

first and second pulley assemblies, mounted to pivot on respective axles at tips of corresponding first and second limbs of a compound bow; each assembly including:

a central string pulley component with a peripheral string groove; and first and second cable pulley components, each having peripheral cable groves, said first and second pulley components being approximately congruent in configuration and orientation, and being fixed in straddling relation with respect to said string pulley component;

a bowstring with opposite ends connected directly to said first and second pulley assemblies such that, at rest condition of the bow, the peripheral string grooves are substantially occupied by wrapped bowstring;

a first cable segment, carried by said first pulley assembly, such that opposite end stretches of said first cable segment extend from the respective cable grooves of said first pulley assembly to anchor to said second limb; and a second cable segment, carried by said second pulley assembly, such that opposite end stretches of said second cable segment extend from the respective cable grooves of said second pulley assembly to anchor said first limb, all such that an end stretch of each said cable segment is positioned to the right of said bowstring and an end stretch of each said segment is positioned to the left of said bowstring; and said cable spreading assembly includes:

said plate, having a right edge and a left edge;

a first traveling fixture with a first element constructed and arranged to retain those of said cable end stretches located to the right of said bowstring and a second element constructed and arranged to couple in sliding engagement with said right edge of said plate; and a second traveling fixture with a first element constructed and arranged to retain those of said cable end stretches located to the left of said bowstring and a second element constructed and arranged to couple in sliding engagement with said left edge of said plate.

6. A compound archery bow according to claim 5, wherein said first and second fixtures each comprise a glider block of which said first element comprises and outer surface carrying approximately parallel slot openings positioned to receive adjacent said cable end stretches and said second element comprises an inner surface carrying a slot opening positioned to receive an adjacent said plate edge.

7. A compound archery bow according to claim 6, wherein said first and second pulley assemblies are each approximately symmetrical with respect to a central reference plane transverse their respective axes of rotation.

8. A compound archery bow according to claim 7, wherein said first cable segment extends through said first pulley assembly such that its midpoint is located internal and at approximately the middle of said central string pulley of said first pulley assembly and said second cable segment extends through said second pulley assembly such that its midpoint is located internal and at approximately the middle of said central string pulley of said second pulley assembly.

9. A compound archery bow according to claim 8, wherein said first and second cable segments are physically anchored to said respective first and second pulley assemblies to hold their respective said midpoints in substantially fixed lateral position with respect to said respective axles.

10. Rigging for a compound archery bow comprising:

first and second pulley assemblies mounted to pivot on axles at tips of corresponding first and second and limbs of a compound bow; each assembly including:

a central string pulley component with a peripheral string groove; and first and second cable pulley components, each having peripheral cable groves, said first and second cable pulley being approximately congruent in configuration and orientation, and being fixed in straddling relation with respect to said string pulley component;

a bowstring with opposite ends connected directly to said first and second pulley assemblies such that, at rest condition of the bow, the peripheral string grooves are substantially occupied by wrapped bowstring;

a first cable segment anchored, at its midpoint to said first pulley assembly, such that opposite end stretches of said first cable segment extend from the respective cable grooves of said first pulley assembly to anchor to said second limb; and a second cable segment, anchored to its midpoint to said second pulley assembly, such that opposite end stretches of said second cable segment extend from the respective cable grooves of said second pulley assembly to anchor to said first limb, in combination with:

a handle riser, with upper and lower respective ends;

a first bow limb, extending from said upper end of said handle riser to terminate in a distal upper limb tip;

a second bow limb, extending from said lower end of said handle riser to terminate in a distal lower limb tip;

said first and second pulley assemblies being mounted to pivot on axles carried by said upper and lower limb tips, respectively, said rigging including a central bow string and a plurality of cable stretches extending approximately parallel said bow string between said upper and lower limb tips such that said bow string is located between left and right said cable stretches; and cable spreading structure extending from said handle to between said left and said right cable stretches, said cable spreading structure being structured and arranged to hold said left and right said cable stretches away from the vicinity of said bow string while permitting free travel of a nocking point of said bowstring from fully drawn to braced position.

* * * * *